US007892004B2

(12) United States Patent
Hertzler et al.

(10) Patent No.: US 7,892,004 B2
(45) Date of Patent: Feb. 22, 2011

(54) CONNECTOR HAVING A SLEEVE MEMBER

(75) Inventors: Christopher Hertzler, Carlisle, PA (US); Robert Walker, Harrisburg, PA (US); William Lenker, Maryville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 154 days.

(21) Appl. No.: 12/269,469

(22) Filed: Nov. 12, 2008

(65) Prior Publication Data

US 2009/0264003 A1 Oct. 22, 2009

(51) Int. Cl.
*H01R 13/62* (2006.01)

(52) U.S. Cl. ..... 439/312

(58) Field of Classification Search ..... 439/271, 439/255, 312, 350, 155, 317, 160, 364
See application file for complete search history.

(56) References Cited

U.S. PATENT DOCUMENTS

| | | | | |
|---|---|---|---|---|
| 3,430,184 | A | 2/1969 | Acord | |
| 3,452,316 | A | 6/1969 | Mocek et al. | |
| 3,723,944 | A | 3/1973 | Gauchat et al. | |
| 4,548,455 | A | 10/1985 | Ezure | |
| 4,645,282 | A * | 2/1987 | Frear | 439/160 |
| 4,695,109 | A * | 9/1987 | Ratchford | 439/155 |
| 4,941,846 | A | 7/1990 | Guimond et al. | |
| 4,954,097 | A | 9/1990 | Sekiguchi | |
| 5,167,522 | A | 12/1992 | Behning | |
| 5,595,499 | A | 1/1997 | Zander et al. | |
| 5,785,545 | A | 7/1998 | Holt | |
| 6,267,612 | B1 | 7/2001 | Arcykiewicz et al. | |
| 6,290,525 | B1 | 9/2001 | Jacobi | |
| 6,361,348 | B1 | 3/2002 | Hall et al. | |
| 6,517,373 | B2 | 2/2003 | Finke et al. | |
| 6,619,876 | B2 | 9/2003 | Vaitkus et al. | |
| 6,692,285 | B2 | 2/2004 | Islam | |
| 6,749,454 | B2 | 6/2004 | Schmidt et al. | |

(Continued)

FOREIGN PATENT DOCUMENTS

DE 10121675 A1 11/2001

(Continued)

OTHER PUBLICATIONS

International Search Report, International Application No. PCT/US2009/006014, International Filing Date Jun. 11, 2009.

(Continued)

*Primary Examiner*—Edwin A. Leon

(57) ABSTRACT

A connector assembly configured to sealably engage with a mating connector. The connector assembly includes a plug assembly that has a mating end configured to be inserted into the cavity of the mating connector. The connector assembly also includes a collar that surrounds the plug assembly. The connector assembly also includes a sleeve member that is positioned between the collar and the plug assembly. The sleeve member surrounds the plug assembly about the central axis and includes a plurality of fingers that extend toward the mating end. The sleeve member is stamped and formed from a common piece of sheet material. The fingers are biased away from the central axis in a flared arrangement when the collar is in the withdrawn position. The lingers press against the wall surface of the mating connector when the collar is moved from the withdrawn position to the locked position.

20 Claims, 8 Drawing Sheets

U.S. PATENT DOCUMENTS

| | | | |
|---|---|---|---|
| 6,769,926 | B1 | 8/2004 | Montena |
| 6,848,931 | B2 | 2/2005 | McMullen et al. |
| 6,884,105 | B2 | 4/2005 | Turck et al. |
| 7,229,303 | B2 | 6/2007 | Vermoesen et al. |
| 7,238,047 | B2 | 7/2007 | Saettele et al. |
| 2004/0219834 | A1 | 11/2004 | Vielhaber |
| 2006/0033218 | A1 | 2/2006 | Hafner et al. |
| 2006/0051999 | A1 | 3/2006 | Allemann et al. |
| 2007/0293076 | A1 | 12/2007 | Fehling et al. |

FOREIGN PATENT DOCUMENTS

| | | | |
|---|---|---|---|
| DE | 10235675 | A1 | 5/2003 |
| DE | 20 2005 009 396 | | 10/2006 |
| DE | 10 2005 057444 | | 3/2007 |
| DE | 102006012194 | A1 | 9/2007 |
| DE | 10 2007 009947 | | 9/2008 |
| EP | 1 282 202 | | 2/2003 |
| EP | 1 603 200 | | 12/2005 |
| EP | 01686660 | A2 | 8/2006 |
| FR | 2 479 580 | | 10/1981 |
| WO | WO-2007/062845 | A1 | 6/2007 |

OTHER PUBLICATIONS

"Snap-Lock SMA Series"; Tyco Electronics; Copyright 2007; 4 Pgs.
"M12 quick-connect technology"; TURCK Industrial Automation; Copyright 2007; 1 Pg.
European Search Report, European Application No. 09158135.5-2214 European Filing Date Aug. 17, 2009.
Turck, Industrial Automation, Quick-Connect Technology, (publication date unknown, at least available as of May 2008), 4 pgs.

* cited by examiner

CONNECTOR HAVING A SLEEVE MEMBER

CROSS-REFERENCE TO RELATED APPLICATIONS

The present application incorporates by reference in the entirety U.S. patent application Ser. No. 12/104,551, filed Apr. 17, 2008.

The present application also includes subject matter that is similar to subject matter disclosed in U.S. patent application Ser. No. 12/269,435, which was filed on Nov. 12, 2008 and is incorporated by reference in the entirety.

BACKGROUND OF THE INVENTION

The invention relates generally to connectors, and more particularly to connectors that form an environmental seal around an electrical or fiber optic connection.

Push-pull type connectors may provide a quick method for establishing a communicative and/or power connection between systems and devices. In one known push-pull type connector, the connector has a cylindrical body that is configured to mate with a mating connector having a cylindrical wall with external threads projecting therefrom. The cylindrical wall defines a cavity that houses contacts configured to engage mating contacts of the push-pull connector. The push-pull connector includes a plug body that is surrounded by six segments, which, in turn, are surrounded by an interlocking sleeve. The segments are made of a compressible, plastic material. To engage the push-pull connector and the mating connector, the plug body is inserted and advanced into the cavity such that the wall of the mating connector slides between the plug body and the six segments. When the plug body is fully inserted into the mating connector, the interlocking sleeve continues to slide over the six segments. The segments are shaped such that the material of the segments is compressed against the threads of the mating connector when the interlocking sleeve slides over the segments. The compressed segments grip or form an interference fit with the mating connector.

However, in order for the push-pull connector described above to form the appropriate interference fit with the mating connector, the segments require a certain size and thickness of the compressible material. The resulting size of the push-pull connector may not satisfy certain industry standards. Furthermore, the process for molding and manufacturing the components of the push-pull connector may be costly. In addition, the compressible plastic material does not provide electrical shielding for the connection.

Accordingly, there is a need for a push-pull connector that forms an environmental seal and/or an electrical shield while satisfying predetermined requirements. Furthermore, there is a need for a push-pull connector that may be constructed in a less costly manner than other known connectors.

BRIEF DESCRIPTION OF THE INVENTION

In one embodiment, a connector assembly configured to sealably engage with a mating connector is provided. The mating connector has a cavity and an outer wall surface. The connector assembly includes a plug assembly that has a loading end and a mating end and a central axis extending therebetween. The mating end is configured to be inserted into the cavity of the mating connector to establish at least one of a communicative and power connection. The connector assembly also has a collar that surrounds the plug assembly about the central axis and is configured to slide in an axial direction between a withdrawn position and a locked position. The connector assembly also has a sleeve member positioned between the collar and the plug assembly. The sleeve member surrounds the plug assembly about the central axis and includes a plurality of fingers that extend toward the mating end. The sleeve member is stamped and formed from a common piece of sheet material. The fingers are biased away from the central axis in a flared arrangement when the collar is in the withdrawn position. The fingers press against the wall surface of the mating connector when the collar is moved from the withdrawn position to the locked position.

Optionally, the sheet material may have a common thickness throughout and may include a metal alloy. Also, each finger may include at least one thread element that projects radially inward. The at least one thread element may be stamped and formed with the sleeve member. The at least one thread element may have an axial position relative to the central axis along the corresponding ringer. The axial position of the at least one thread element on one finger may be different from the axial position of the at least one thread element on an adjacent finger. In addition, the connector assembly and mating connector may form at least one of an environmental seal and an electrical shield.

In another embodiment, a connector assembly that is configured to sealably engage with a mating connector is provided. The mating connector has a cavity defined by an inner wall surface. The connector assembly includes a plug body that has a loading end and a mating end and a central axis extending therebetween. The mating end is configured for insertion into the cavity to establish at least one of a communicative and power connection. The plug body may have an outer surface that includes a plurality of ramp elements that are located proximate to the mating end and project radially outward from the outer surface. Also, the connector assembly includes a sleeve member that surrounds the outer surface of the plug body and includes a plurality of fingers that extend toward the mating end. Each finger is biased toward the central axis. The connector assembly also includes a collar that is operatively coupled to the sleeve member and is configured to rotate the sleeve member about the central axis when the collar is rotated between a withdrawn position and a locked position. Each finger engages a corresponding ramp element when the collar is rotated to the locked position. The fingers flex away from the central axis and press against the wall surface when the collar is rotated to the locked position.

Optionally each ramp element may include an incline portion that first engages the corresponding finger when the sleeve member is rotated. The incline portion may have a substantially planar surface. The fingers may have a maximum height away from the outer surface and the plug body may include a lip that projects radially outward from the outer surface and proximate to the mating end. The lip projects a distance away from the outer surface that is greater than the maximum height of the fingers.

DETAILED DESCRIPTION OF THE INVENTION

Figure 1:
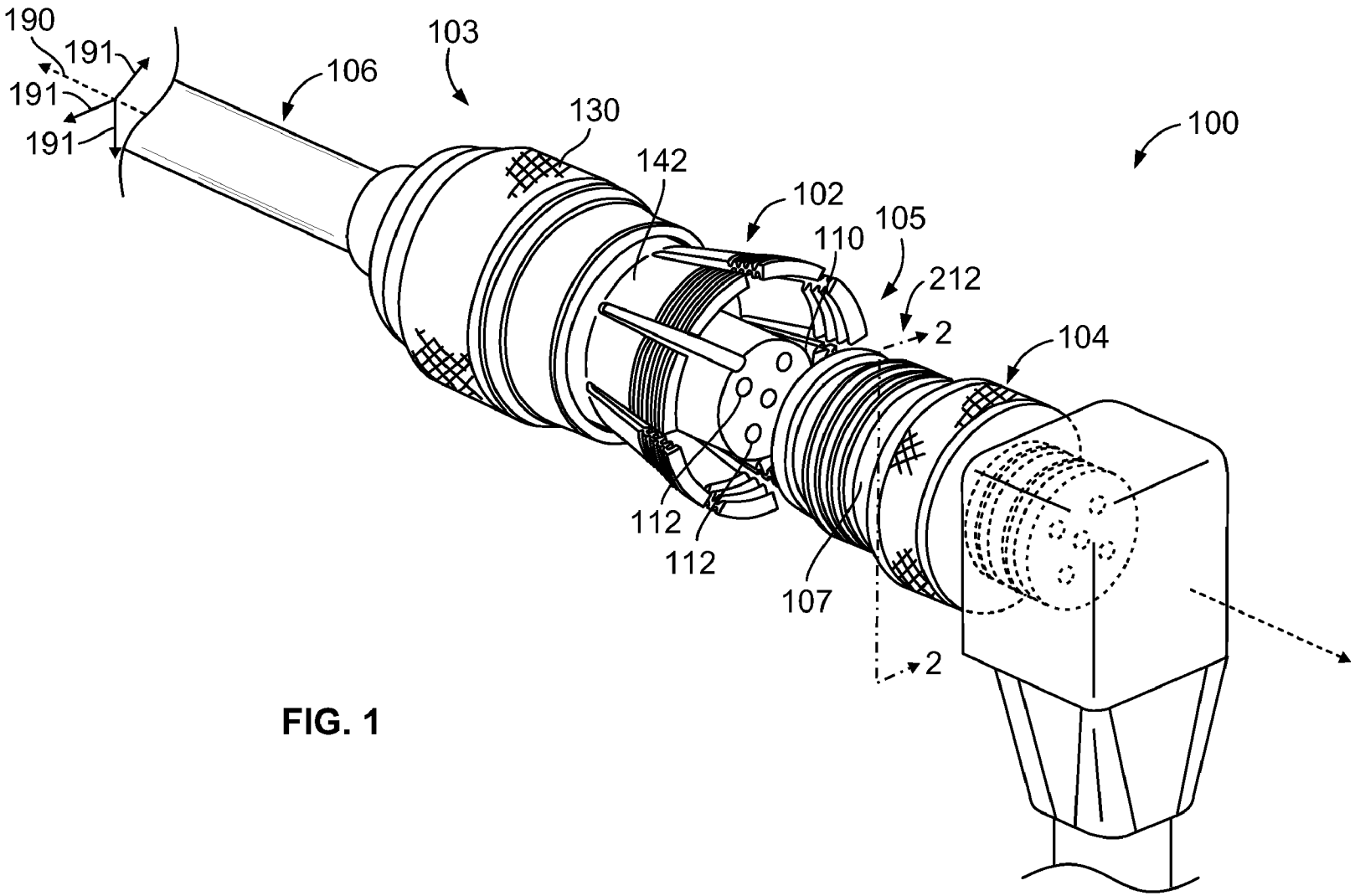
FIG. 1 is a perspective view of a connector system including a mating connector and a connector assembly formed in accordance with one embodiment.

FIG. 1 is a perspective view of a connector system 100 formed in accordance with one embodiment. The connector system 100 is used to connect a cable assembly 106 to an electrical device or system (not shown) and includes a connector assembly 102 (also referred to as a push-pull connector or first connector) and a mating connector 104 (also referred to as a second connector). In FIG. 1, the connector assembly 102 is disengaged from the mating connector 104. The connector assembly 102 extends between a loading end 103 and a mating end 105 and extends along a longitudinal or central axis 190. The connector assembly 102 may include a plug body 110, a sleeve member 142 that surrounds the plug body 110, and a collar 130 that surrounds the sleeve member 142. The collar 130 is configured to slide between a withdrawn position (shown in FIG. 1) to a locked position (shown in FIG. 5). The connector assembly 102 may include other components and features, such as those described in U.S. patent application Ser. No. 12/104,551, filed Apr. 17, 2008, or those described in the U.S. patent application Ser. No. 12/269,435; filed contemporaneously herewith, both of which are incorporated by reference in the entirety.

It is to be understood that the benefits herein described are also applicable to other connectors and connector assemblies. For example, in the illustrated embodiment, the connector assembly 102 is a female connector and the mating connector 104 is a male connector. However, those skilled in the art understand that female connectors may have male parts, e.g., the plug body 110, in addition to the female parts, e.g., contact channels 112. Likewise, male connectors may have female parts, e.g., a cavity 208 (shown in FIG. 2), in addition to the male parts, e.g., mating contacts 202 (shown in FIG. 2). Furthermore, alternative embodiments of the connector assembly 102 may be a male connector that engages a female connector. For example, the connector assembly may be the connector assembly 502 shown in FIG. 8 or the connector assemblies described in the U.S. patent application Ser. No. 12/269,435, which is incorporated by reference in the entirety. Also, although the illustrated embodiment of the connector assembly 102 is a push-pull type connector, alternative embodiments of the connector assembly 102 are not required to be a push-pull type. As such, the following description is provided for purposes of illustration, rather than limitation, and is but one potential application of the subject matter herein.

Also shown in FIG. 1, the mating connector 104 includes a stem wall 204 that defines a cavity 208 (shown in FIG. 2) configured to receive the plug body 110. The stem wall 204 also has threads 212 that project radially outward (i.e., in a direction that is perpendicular to the central axis 190 as indicated by axis 191). The threads 212 extend around or encircle a surface of the stem wall 204. To mate or engage the connector assembly 102 with the mating connector 104, the connector assembly 102 is moved in an axial direction (i.e., along the central axis 190) toward the mating connector 104. The plug body 110 is inserted into the cavity 208. When the plug body 110 is engaged with the cavity 208, the collar 130 slides toward the mating end 105 and engages fingers (discussed below) of the sleeve member 142. The fingers 146 engage the stem wall 204 and form an environmental seal to protect the electrical and/or fiber optic connection that extends the connector system 100. In addition, the connector assembly 102 may provide electrical shielding for the connection.

Figure 7:
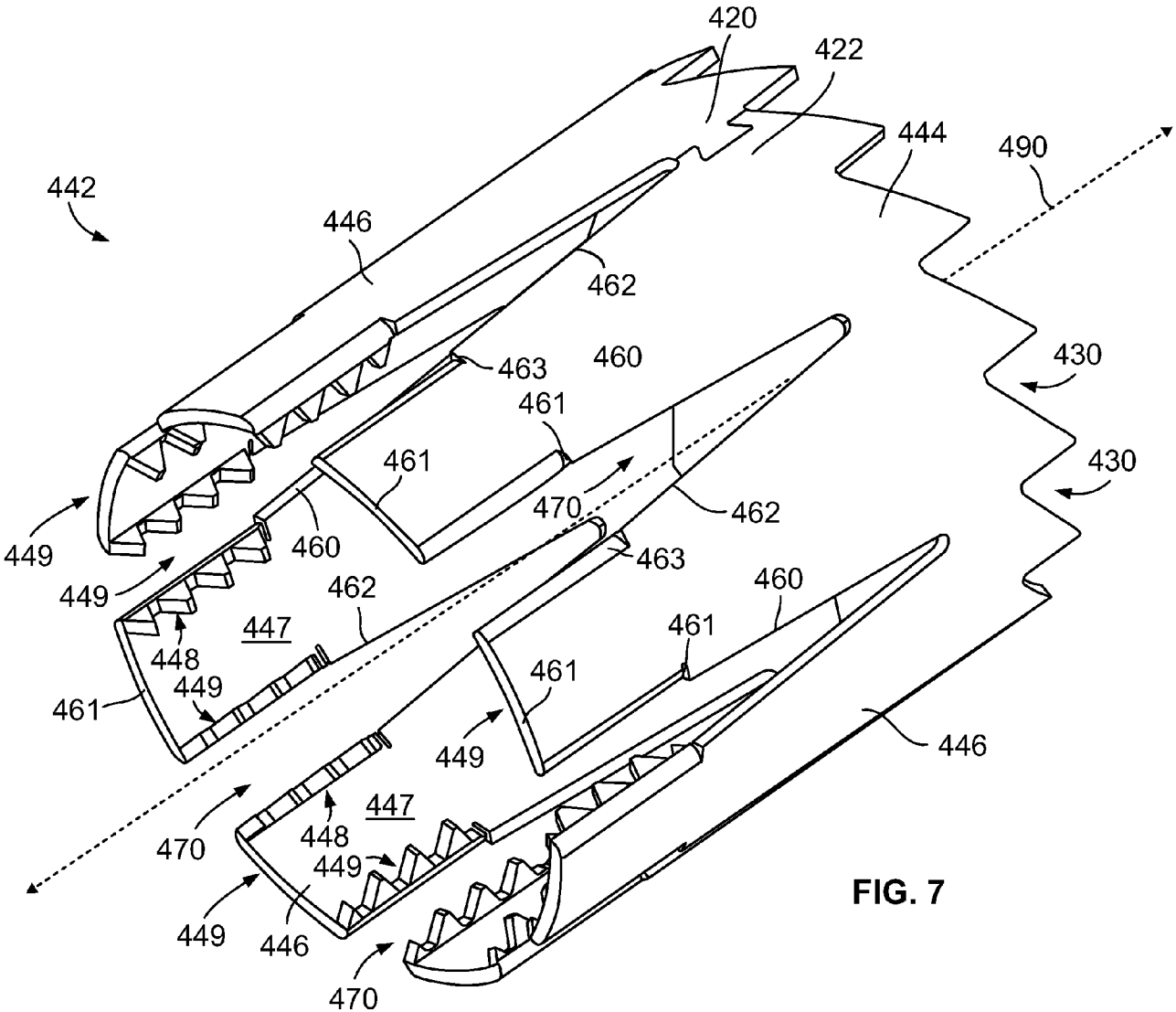
FIG. 7 is a perspective view of yet another sleeve member that may be used with the connector assembly shown in FIG. 1.
Figure 8:
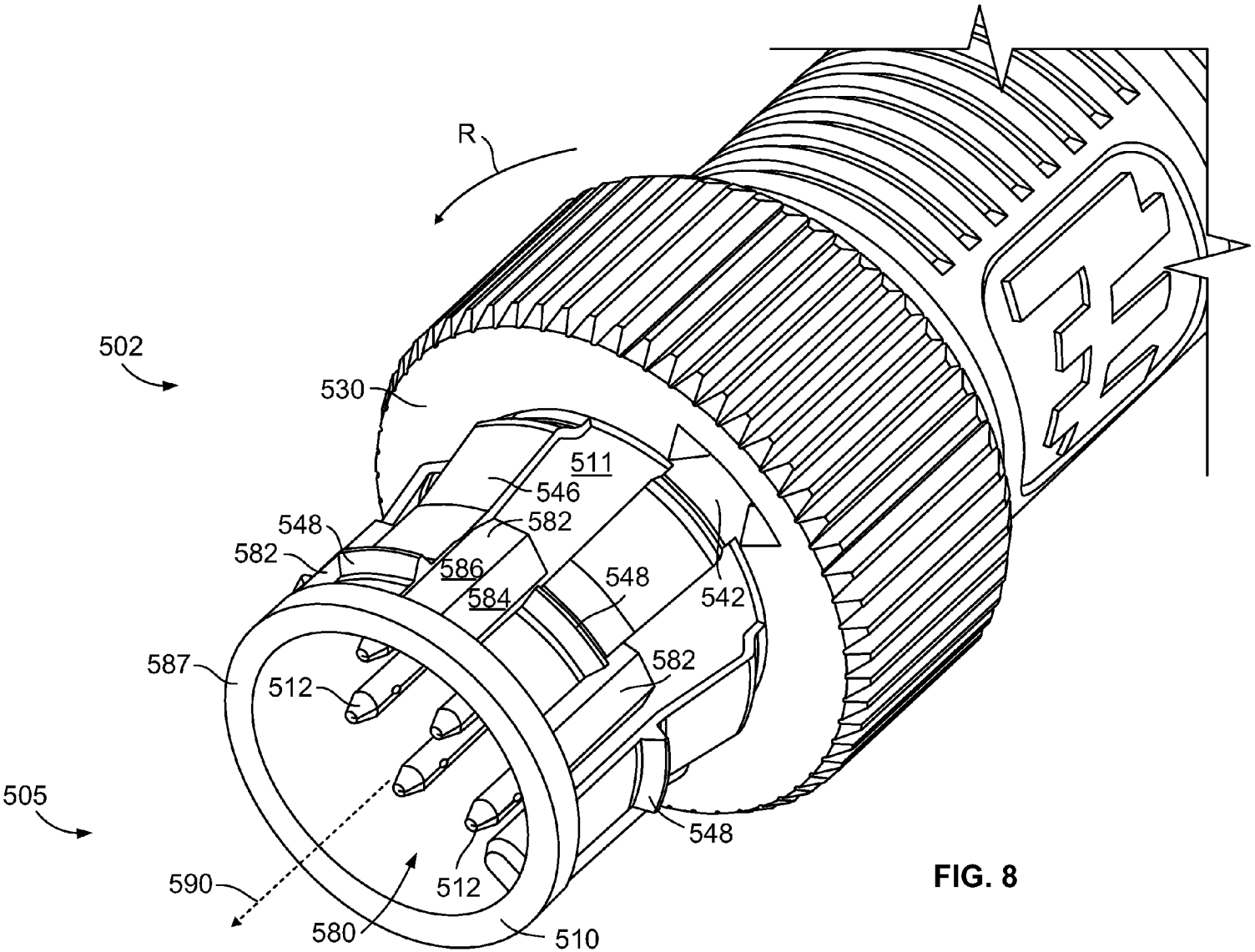
FIG. 8 is a perspective view of a connector assembly formed in accordance with another embodiment.

The connector assembly 102 shown in FIG. 1 is configured to mate with a mating connector that has external threads, such as the threads 212. Other embodiments, such as the connector assembly 502 shown in FIG. 8, may be configured to mate with a mating connector having internal threads. Both of the connector assemblies 102 and 502 may engage the corresponding mating connector without substantial rotation for engaging the threads (e.g., without rotating more than 10°). However, alternative embodiments may require rotating the connector assembly a larger amount. Furthermore, as will be discussed in greater detail below, the connector assembly may utilize a sleeve member, such as sleeve members 142 (FIG. 1), 342 (FIG. 6), 442 (FIG. 7), and 542 (FIG. 8). The sleeve members may be stamp and formed from a common sheet of material, such as a metal alloy or composite. The sheet of material may have a common thickness throughout. Furthermore, the sleeve member may have various features to facilitate engaging the corresponding connector assembly to the corresponding mating connector.

Also shown in FIG. 1, the plug body 110 may have a plurality of contact channels 112 that enclose mating contacts (not shown), which may be electrical contacts or fiber-optic termini. The plug body 110 is inserted into the cavity 208 where mating contacts 202 (shown in FIG. 2) are inserted into the contact channels 112 to connect with the mating contacts of the connector assembly 102. However, the connector assembly 102 is just one example of a connector assembly that may benefit from the features described herein. The connector assembly 102 and the mating connector 104 may have a variety of configurations or may be a variety of types. For example, the connector assembly 102 may have a registered jack plug or an LC connector that engages a corresponding receiver within the mating connector. Furthermore, the plug body 110 may be a head for a coaxial cable.

Figure 2:
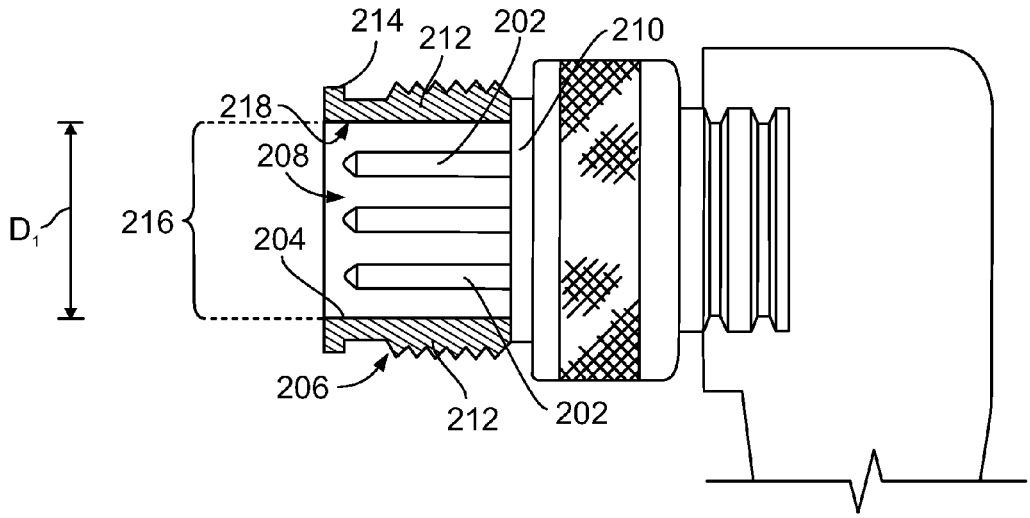
FIG. 2 is a cross-sectional view of a mating connector taken along the line 2-2 shown in FIG. 1.

FIG. 2 illustrates a cross-sectional view of a portion of the mating connector 104 taken along the line 2-2 in FIG. 1. The stem wall 204 has an outer wall surface 206 and an inner wall surface 218. The stem wall 204 may include a front edge 214 that defines an opening 216 to the cavity 208 that extends in an axial direction therein. The opening 216 has a diameter $D_1$. The stem wall 204 may surround and protect the mating contacts 202 held within. The mating connector 104 may also have a contact base 210 at a rear end of the cavity 208. The contact base 210 may function as a positive stop when the plug body 110 (FIG. 1) is inserted into the cavity 208. Also shown, the wall surface 206 may include a plurality of ridges or threads 212 that extend radially outward from the wall surface 206. (The radial direction is indicated by the axes 191 shown in FIG. 1.) In alternative embodiments, the threads 212 may extend radially inward from the wall surface 206. The threads 212 may extend partially or completely around the wall surface 206 and may extend from proximate to the front edge 214 to proximate to the contact base 210. However, in alternative embodiments, the wall surface 206 may form a single ridge or bump configured to be gripped by the connector assembly 102.

Figure 3:
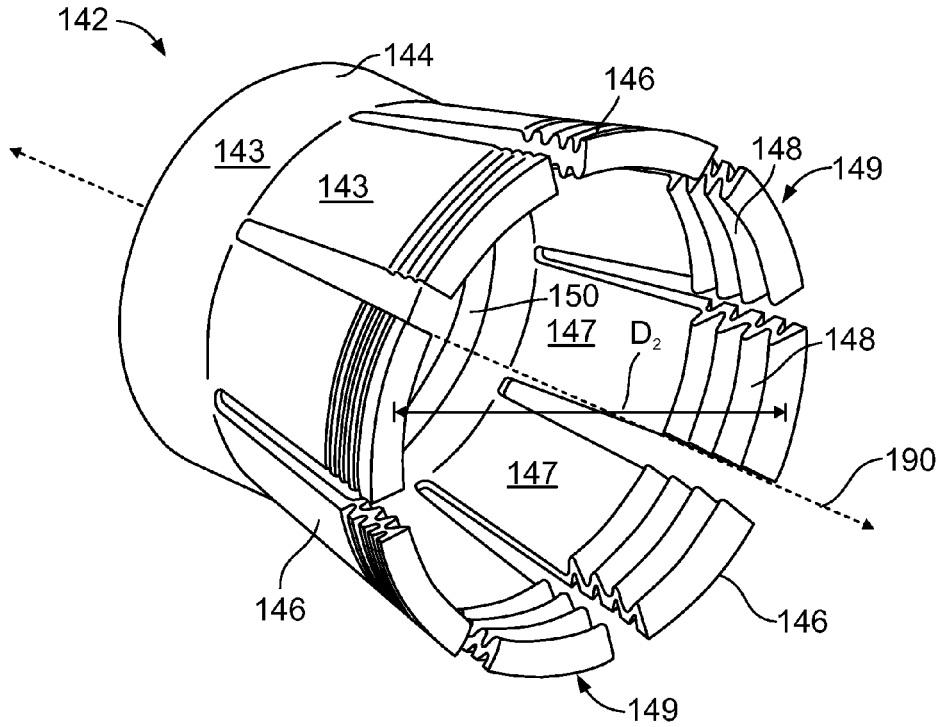
FIG. 3 is a sleeve member that may be used with the connector assembly shown in FIG. 1.
Figure 4:
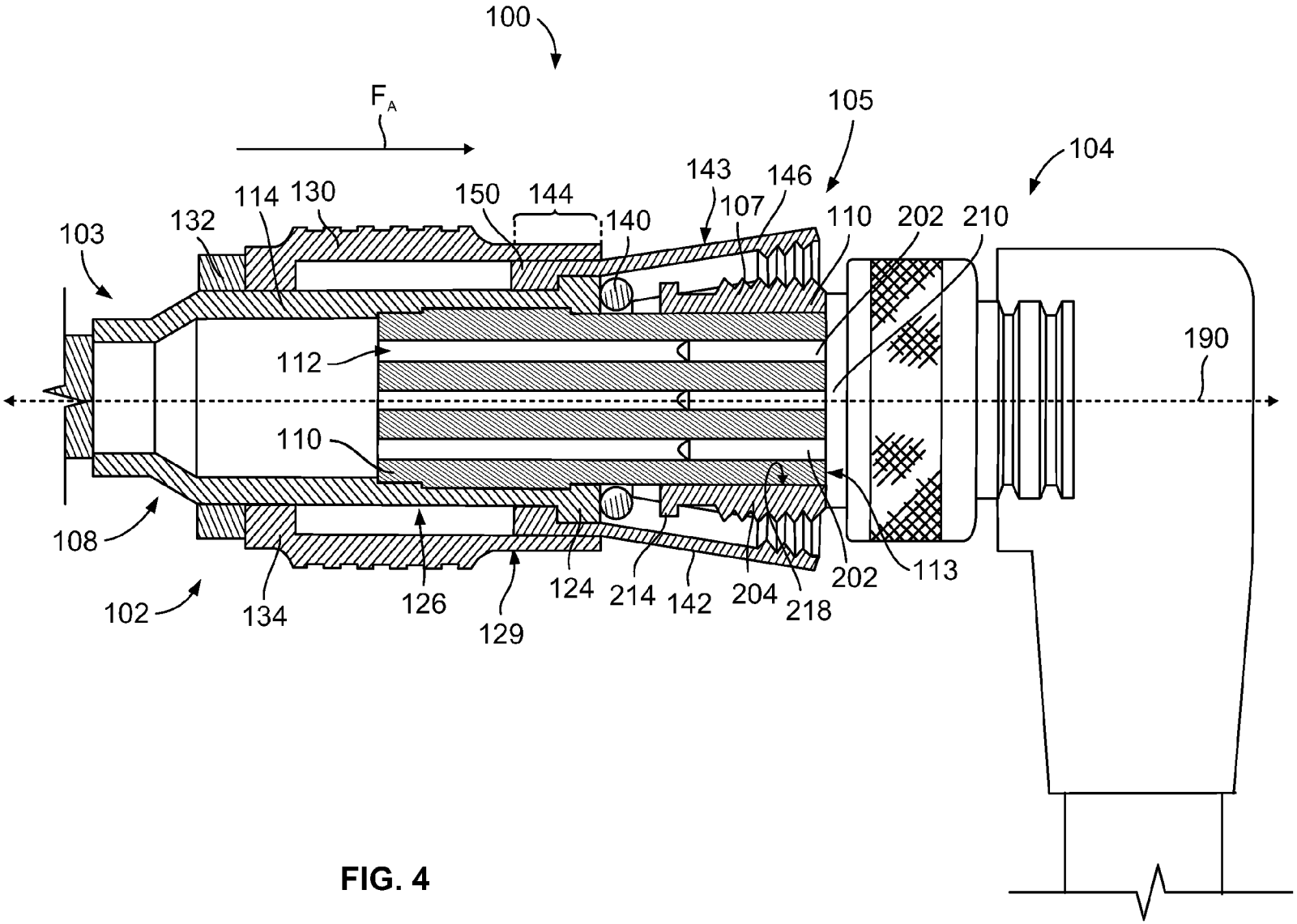
FIG. 4 is a cross-sectional view of the connector assembly shown in FIG. 1 before engaging the mating connector.

FIG. 3 is an enlarged view of the sleeve member 142. The sleeve member 142 may include a base portion 144 that is configured to extend around the plug body 110 (FIG. 1). As such, the base portion 144 may have a substantially cylindrical shape that extends in the axial direction. The base portion 144 may include a shoulder or grip 150 that extends radially inward. Furthermore, in the illustrated embodiment, the sleeve member 142 includes a plurality of fingers 146 that extend outward from the base portion 144 to a distal end 149. Each finger 146 may be defined between an inner surface 147 and an outer surface 143 and has a substantially constant radius of curvature. Each finger 146 may be moved from a retracted position (shown in FIG. 3) to an engaged position (shown in FIG. 5). As such, the plurality of fingers 146 may move from an open or flared arrangement as shown in FIG. 4 to a closed arrangement shown in FIG. 5 where the connector assembly 102 (FIG. 1) is fully mated with the mating connector 104 (FIG. 1). In the flared arrangement, the inner surfaces 147 of the fingers 146 proximate to the distal ends 149 may form an opening in the shape of a circle that has a diameter $D_2$ that is greater than the diameter $D_1$. The fingers 146 may be biased in the flared arrangement and extend along and away from the central axis 190 toward the mating end 105.

As shown, in the flared arrangement the fingers 146 are in a relaxed state. In the closed arrangement, the fingers 146 are compressed and held against the wall surface 206 (FIG. 2) by the collar 130 and form a substantially cylindrical body. In the illustrated embodiment, the fingers 146 may be substantially identical arcuate portions of the cylindrical body that lie directly adjacent (i.e., touching or almost touching) to each other when the fingers 146 are in the closed arrangement. The inner surface 147 may be shaped or configured to complement the wall surface 206. Furthermore, the inner surface 147 may include one or more thread elements 148 that extend radially inward from the inner surface 147. The thread elements 148 may be positioned proximate to the distal end 149 of the corresponding finger 146 and be configured to engage the threads 212 (FIG. 1) extending from the wall surface 206.

In addition, the outer surface 143 may be substantially smooth as the outer surface 143 extends axially from the base portion 144 toward the distal ends 149 of the fingers 146. More specifically, when the fingers 146 are in a closed arrangement, a tangential line extending along the outer surface 143 may be parallel to the central axis 190. The outer surface 143 may not include ridges or protrusions that interfere with the collar 130 when the collar 130 is moved axially forward. Also, the fingers 146 may have a substantially linear body such that a tangential line of the inner surface 147 (not including the thread elements 148) is parallel to the tangential line of the outer surface 143.

In alternative embodiments, the fingers 146 may not form a substantially cylindrical body but may be separated from each other a predetermined distance such that gaps exist between the adjacent fingers 146 when the fingers 146 are in the closed arrangement. Furthermore, the fingers 146 may have other shapes. For example, the fingers 146 may include a narrower trunk that extends from the base portion 144 and gradually widens such that the fingers 146 do not touch each other at the trunks but may touch each other at the distal ends 149 of the fingers 146. With less material extending from the base portion 144, the fingers 146 may require less force to compress. Alternatively, the fingers 146 may include wider trunks that taper as the fingers 146 extend to the corresponding distal end 149.

In the illustrated embodiment, the sleeve member 142 is stamped and formed from a resiliently flexible material, such as a metal alloy or composite. The sleeve member 142 may also be fabricated from a plastic or other dielectric material. Furthermore, the sleeve member 142 may be manufactured by molding or machining processes. In one embodiment, the sleeve member 142, including the fingers 146 and the thread elements 148, may be stamped and formed from a common sheet of material having a substantially constant thickness throughout. After the fingers 146 and thread elements 148 are stamped and formed, the sleeve member 142 may be rolled into a predetermined shape (e.g., cylindrical). Before or after rolling the sleeve member 142, the fingers 146 may be configured into the flared arrangement and cured in order to maintain the biased positions while in a relaxed state.

In such embodiments where the sleeve member 142 is stamped and formed from sheet metal, the stock of sheet metal may have a thickness that is less than other materials. For example, the sheet metal may be approximately 0.012 in. thick. However, as described above, the sleeve member 142 may be fabricated from many materials and may be formed by other processes.

Figure 5:
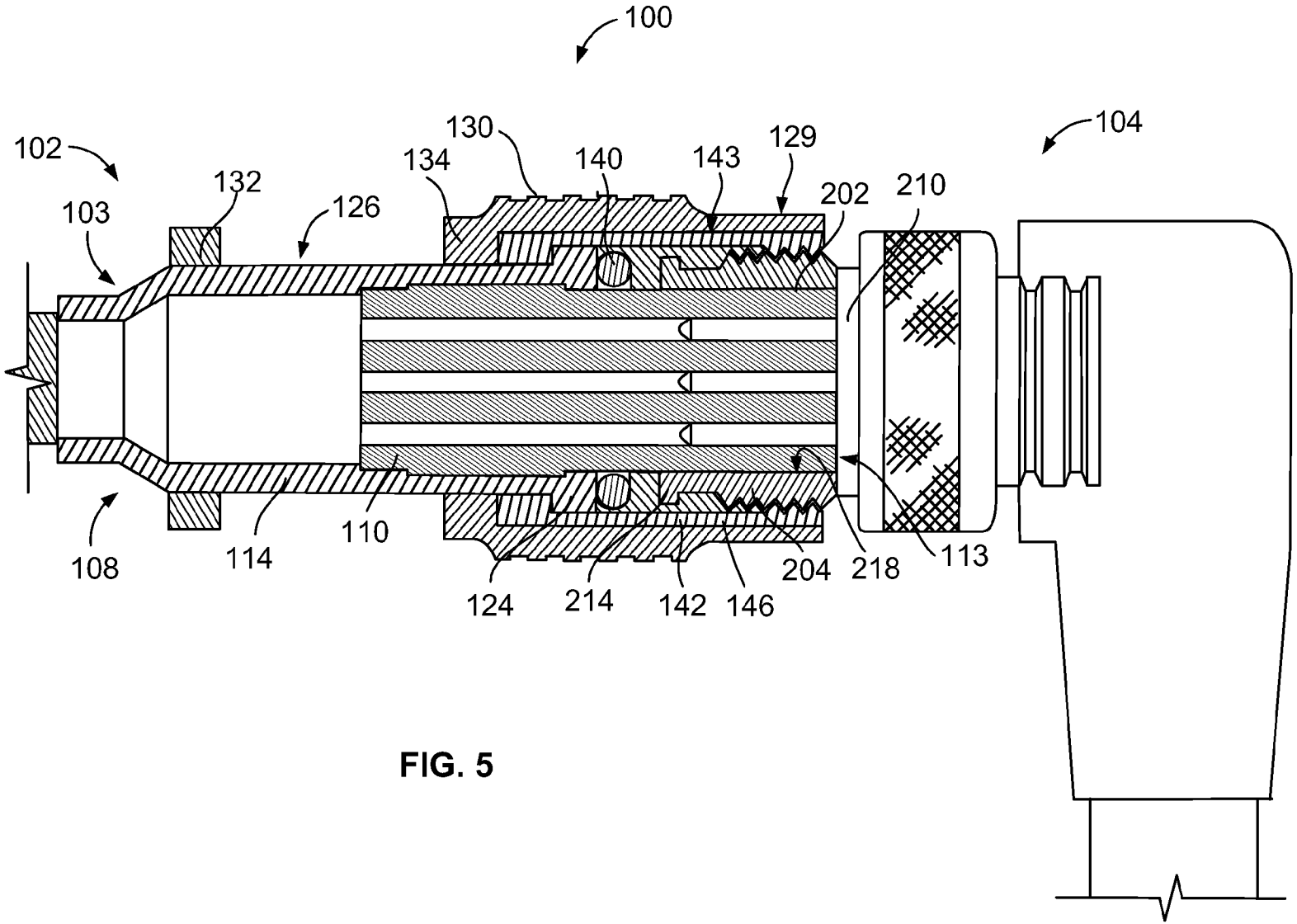
FIG. 5 is a cross-sectional view of the connector assembly shown in FIG. 1 after engaging the mating connector.

FIG. 4 is a cross-sectional view of the connector system 100 when the connector assembly 102 and the mating connector 104 are disengaged, and FIG. 5 is a cross-sectional view of the connector system 100 when the connector assembly 102 and the mating connector 104 are fully engaged. As shown in FIGS. 4 and 5, the connector assembly 102 also includes a plug assembly 108 that extends between the loading end 103 and the mating end 105. The plug assembly 108 includes an intermediate housing 114 and the plug body 110 which is inserted into the intermediate housing 114. The intermediate housing 114 couples to and engages the cable assembly 106 (FIG. 1). The intermediate housing 114 may include an outer housing surface 126 and a shoulder 124 that extends radially outward therefrom. Although the intermediate housing 114 and the plug body 110 are separate components in the illustrated embodiment, the features described herein may be integrally formed into one component for alternative embodiments. The plug assembly 108 may also include a sealing band 140. The sealing band 140 may be made from a compressible material (e.g., an o-ring) and is configured to grip and be held in a predetermined position along the plug body 110 and proximate to the shoulder 124.

As shown in FIGS. 4 and 5, the collar 130 surrounds at least a portion of the plug assembly 108 about the central axis 190 (FIG. 4) and is configured to slide in the axial direction along the housing surface 126 between a withdrawn position (FIG. 4) and a locked position (FIG. 5). As shown in FIG. 4, in the withdrawn position, the collar 130 is proximate to the loading end 103 against a retaining member 132. While in the withdrawn position, a rim portion 129 of the collar 130 surrounds the base portion 144 of the sleeve member 142 allowing the fingers 146 to be in the relaxed state and in the flared arrangement. To mate the connector assembly 102 and the mating connector 104 together, an axial force $F_A$ is applied to the connector assembly 102 to advance the connector assembly 102 toward the mating connector 104 along the central axis 190 (FIG. 4). The plug body 110 is inserted through the opening 216 (FIG. 2) and into the cavity 208 (FIG. 2). As discussed above the plug surface 116 (FIG. 3) and a front portion of the plug body 110 may be configured to mate with the inner surface 218 of the stem wall 204. Although not shown, the plug body 110 and the stem wall 204 may have features (e.g., keys and grooves) to facilitate orienting the plug body 110 during engagement. As the plug body 110 advances through the cavity 208, the mating contacts 202 are inserted into the contact channels 112 of the plug body 110 and engage corresponding mating contacts (not shown) within the contact channels 112. Also, as the connector assembly 102 engages the mating connector 104, the front edge 214 slides along the plug surface 116 toward the sealing band 140. The sleeve member 142 and the fingers 146 are in the flared arrangement. The plug body 110 continues to advance through the cavity 208 until the front end 113 of the plug body 110 engages the contact base 210 and/or until the Front edge 214 of the stein wall 204 engages the sealing band 140.

When the plug body 110 engages the contact base 210 and/or the front edge 214 of the stem wall 204 engages the sealing band 140, the plug body 110 stops advancing forward through the cavity 208. However, if the axial force $F_A$ continues to be applied, the collar 130 then begins to advance and slide over the outer surface 143 of the sleeve member 142. The collar 130 engages and compresses the fingers 146 into the wall surface 206. In the illustrated embodiment the outer surface 143 of the sleeve member 142 is substantially smooth allowing the collar 130 to slide freely over the outer surface 143 until a grip portion 134 of the collar 130 engages the base portion 144 of the sleeve member 142. As such, the collar 130 is in the locked position.

In alternative embodiments, the base portion 144 of the sleeve member 142 may include barbed cut-outs along an edge of the base portion that is proximate to the loading end 103 (FIG. 1). The barbed cut-outs may be substantially triangularly shaped such as those described in U.S. patent application Ser. No. 12/104,551, which is incorporated by reference in its entirety. In such embodiments, the collar 130 may include bar members (also described in the aforementioned patent application) that project from the grip portion 134 along an inner surface of the collar 130. The bar members may have a complementary, mateable shape for engaging the barbed cut-outs. The interaction between the bar members and the barbed cut-outs may provide a tactile indication to an operator that the collar 130 and the sleeve member 142 are in the locked position. Furthermore, the bar members and the barbed cut-outs may facilitate holding the collar 130 in position so that the collar 130 is not inadvertently or easily removed. Alternatively, there may be other mechanisms for holding the collar 130 in position or providing a tactile indication to the operator.

Returning to FIG. 5, as shown, the fingers 146 are fully compressed against the wall surface 206 (FIG. 2) such that the fingers 146 and the base portion 144 form a substantially cylindrical body. In the illustrated embodiment, the fingers 146 and the wall surface 206 are electrically connected in the locked position. Also shown in FIG. 5, when the collar 130 is in the locked position and the fingers 146 are in the closed arrangement, the sealing band 140 may be compressed by one or more of the plug surface 116, the fingers 146, the shoulder 124, and the front edge 214. As such, the connector assembly 102 and the mating connector 104 may form an environmental seal to protect the electrical and/or optical connection from the surrounding environment and may also form an electrical shield.

To disengage the connector assembly 102 with the mating connector 104, a withdrawal force is applied to the collar 130 in the opposite direction of the axial force $F_A$ causing the collar 130 to slide backward toward the retaining member 132. As the collar 130 is withdrawn and slides onto the base portion 144, the fingers 146 may move from the closed arrangement to the flared arrangement (i.e., flex from a compressed state to the relaxed state). In an alternative embodiment, if the sealing band 140 is partially compressed by the fingers 146, the sealing band 140 exerts an outward force against the fingers 146. When the collar 130 is retracted, the sealing band 140 may facilitate forcing the fingers 146 outward into the flared arrangement.

Figure 6:
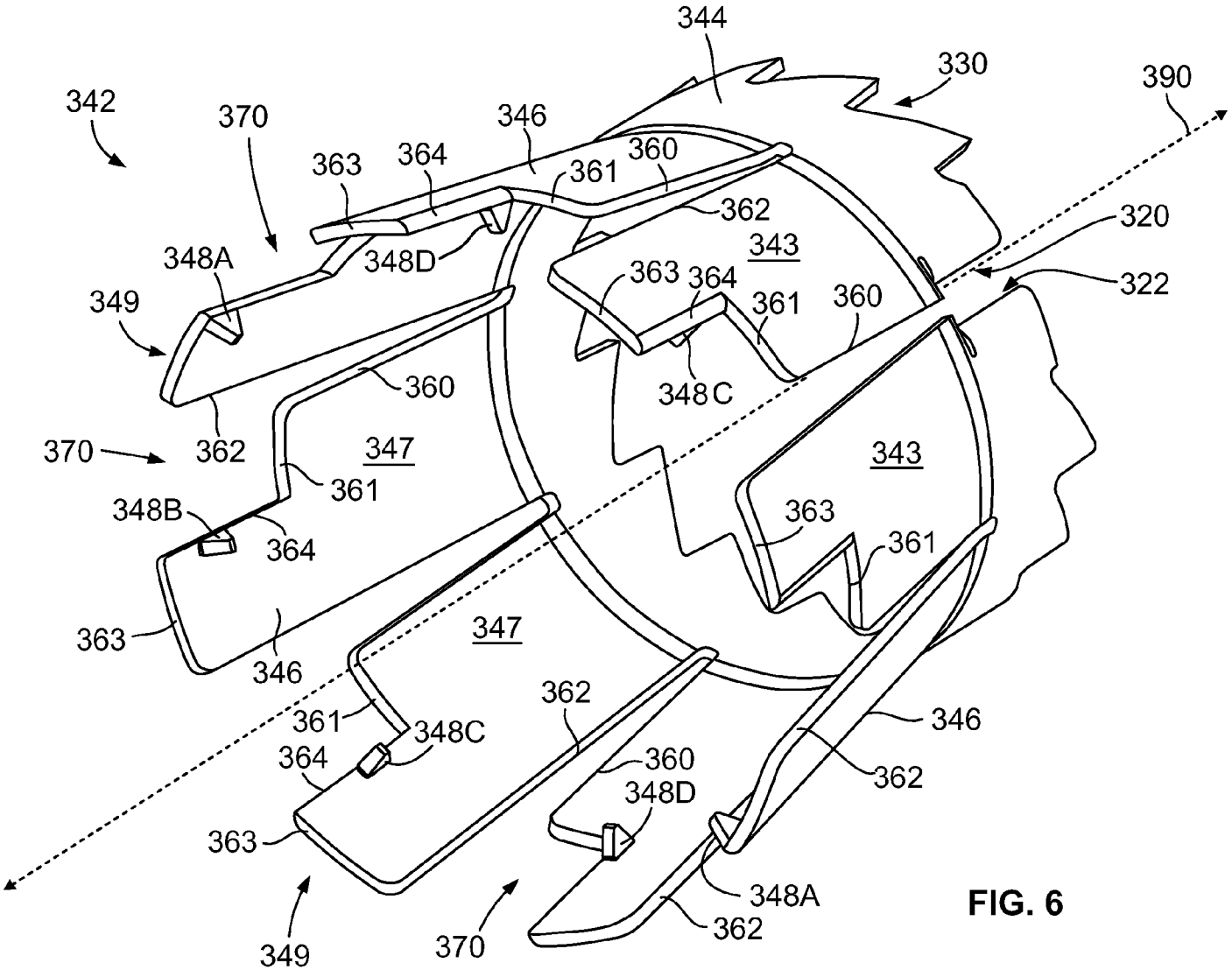
FIG. 6 is a perspective view of another sleeve member that may be used with the connector assembly shown in FIG. 1.

FIG. 6 is a perspective view of a sleeve member 342, which may be utilized by a connector assembly (not shown) formed in accordance with another embodiment. The connector assembly may have similar components and operate in a similar manner as the connector assembly 102 described above. As shown, the sleeve member 342 may include a base portion 344 that is configured to extend around a plug body (not shown) of the corresponding connector assembly. The base portion 344 may include two ends 320 and 322 that are positioned proximate to each other when the sleeve member 342 is rolled into shape. (The sleeve member is rolled about a central axis 390 in FIG. 6.) Furthermore, the base portion 344 may include barbed cut-outs 330 that interact with bar members (not shown) to provide a tactile indication to an operator that the connector assembly is in the locked position. The barbed cut-outs 330 and the bar members are more fully described in U.S. patent application Ser. No. 12/104,551, filed Apr. 17, 2008, which is incorporated by reference in the entirety.

Furthermore, in the illustrated embodiment, the sleeve member 342 includes a plurality of fingers 346 that extend outward from the base portion 344 to distal ends 349. Each finger 346 may be defined between an inner surface 347 and an outer surface 343 and has a substantially constant radius of curvature. The fingers 346 may be moved from a flared arrangement as shown in FIG. 7 to a closed arrangement (not shown) when the connector assembly is fully mated with a mating connector (not shown). The fingers 346 may be biased or configured to be in the flared arrangement when the fingers 346 are in a relaxed state and extend along and away from the central axis 390 toward a mating end (not shown) of the connector assembly.

The fingers 346 may have various shapes and configurations. For example, as shown in FIG. 6, each finger 346 is partially defined by and extends along longitudinal edges 360 and 362. The longitudinal edges 360 and 362 extend from the base portion 344 to forward-facing arcuate edges 361 and 363, respectively. When the fingers 346 are in the engaged position, the longitudinal edges 360 and 362 extend parallel to the longitudinal axis 390. The longitudinal edge 360 of one finger 346 may abut the longitudinal edge 362 of another finger 346 (i.e., the longitudinal edges 360 and 362 may touch or lie directly adjacent to one another). The arcuate edges 361 and 363 may extend in a perpendicular direction to the longitudinal edges 360 and 362 and have a common radius of curvature. As shown, each finger 346 has a cut-out 370 that is defined by the arcuate edge 361 and a longitudinal edge 364 that extends from the arcuate edge 361 to the arcuate edge 363.

The inner surface 347 may include one or more thread elements 348 that extend radially inward from the inner surface 347. More specifically, the thread elements 348A-D may be located along the corresponding longitudinal edge 364 and project radially inward toward the central axis 390. The thread elements 348A-D are configured to engage threads (not shown) that extend radially outward from a wall surface (not shown) of the mating connector. In the illustrated embodiment, the thread elements 348A-D are individual projections or teeth.

To manufacture the sleeve member 342, the sheet material may be stamped to form the separate fingers 346 and the base portion 344. The cut-outs 370 are also stamped and removed from the sheet material. The portions of the sheet material that are cut out may account for the features that eventually form the thread elements 348A-D. For example, after the cut-out 370 is removed, a tooth projection may be left behind that projects from the longitudinal edge 364 into the space of the cut-out 370. The tooth projection may then be bent inwardly such that the tooth projection extends toward the central axis 390 when the sleeve member 342 is fully formed.

In alternative embodiments, the thread elements 348A-D may be formed by embossing the sheet material. For example, a mechanical device or element may be pressed onto one side of the sheet material to form a divot thereby creating a projection on the other side. Furthermore, other manufacturing processes may be used to create the thread elements 348A-D.

As shown, the thread elements 348A-D may have varying axial positions along the corresponding longitudinal edge 364. For example, as shown in FIG. 6, the thread elements 348A are located proximate to the corresponding distal end 349. The thread elements 348B (only one is shown in FIG. 6) may be closer to the arcuate edge 361 than the thread element 348A. Likewise, the thread elements 348C are closer to the corresponding arcuate edges 361 than the thread elements 348B, and the thread elements 348D are proximate to the corresponding arcuate edges 361. As such, in the illustrated embodiment, each finger 346 may have at least one thread element 348 (e.g., tooth) that has an axial position along the corresponding longitudinal edge 364 that is different from an axial position of at least one thread element 348 that is on the adjacent fingers 346. Although only one thread element 348 is shown on the fingers 346, alternative embodiments of the sleeve member 342 may have more than one thread element 348 on each finger 346. The thread elements 348 in such embodiments may have common or different locations with respect to thread elements 348 on other fingers 346.

As shown, in the illustrated embodiment, the fingers 348A-D have four different axial positions. However, in alternative embodiments, there may be greater or fewer axial positions. In one embodiment, the thread elements 348A-D have three different axial positions. Furthermore, although the sleeve member 342 includes only one thread element 348 on a longitudinal edge 364, alternative embodiments may have more than one thread element, more than one type of thread element (e.g., teeth and ridges), and thread elements that project from a variety of positions including a position that is not along a longitudinal edge. For example, a thread element may project from an arcuate edge or from the inner surface.

FIG. 7 is a perspective view of a sleeve member 442, which may be utilized by a connector assembly (not shown) formed in accordance with another embodiment. The connector assembly may have similar components and operate in a similar manner as the connector assembly 102 described above. As shown, the sleeve member 442 many include a base portion 444 that is configured to extend around a plug body (not shown) of the corresponding connector assembly. The base portion 444 may include two ends 420 and 422 that are coupled to each other when the sleeve member 442 is rolled into shape. (The sleeve member is rolled about a central axis 490 in FIG. 7.) The ends 420 and 422 may be configured to couple or fasten to one another by forming an interference fit or using other fastening mechanisms. Similar to the sleeve member 342 described above, the base portion 444 may include barbed cut-outs 430 that interact with bar members (not shown) to provide a tactile indication to an operator that the connector assembly is in the locked position.

The sleeve member 442 also includes a plurality of fingers 446 that extend outward from the base portion 444 to distal ends 449. The fingers 446 are in a closed arrangement in FIG. 7, but have a flared arrangement when each finger 446 is in a relaxed state as described above with respect to the sleeve members 142 and 342. The fingers 446 may have a various shapes and configurations. For example, as shown in FIG. 7, each finger 446 is partially defined by and extends along longitudinal edges 460 and 462. The longitudinal edges 460 and 462 extend from the base portion 444 to a common arcuate edge 461. The ringers 446 are separated by cut-outs 470 such that the longitudinal edge 460 of one finger 446 may extend along and oppose the longitudinal edge 462 of another finger 446 across the Cut-Out 470. Also shown, each finger 446 has a pair of slits 461 and 463 on each longitudinal edge 460 and 462, respectively. In the illustrated embodiment, the slits 461 and 463 are located in a substantially common position (i.e., a common distance away from the base portion 444), but the slits 461 and 463 may be in different positions along the corresponding edges in alternative embodiments.

Also shown, each finger has an inner surface 447 that may include a plurality of thread elements 448 and 449 that extend radially inward from the inner surface 447. More specifically, the thread elements 448 and 449 may be located along the corresponding longitudinal edge 460 and 462, respectively, and project radially inwardly toward the central axis 490. The thread elements 448 and 449 are configured to engage threads (not shown) that extend radially outward from a wall surface (not shown) of a mating connector. In the illustrated embodiment, the thread elements 448 and 449 are a series of individual projections or teeth. When the sleeve member 442 is formed, material is stamped and removed from the sleeve member 442 to form the cut-outs 470, the fingers 446, and the corresponding thread elements 448 and 449. Furthermore, the slits 461 and 463 are made on the corresponding edge. The series of thread elements 448 and the series of thread elements 449 may then be bent inwardly. The sleeve member 442 may be rolled into shape before or after bending the thread elements 448 and 449.

In the illustrated embodiment, the series of thread elements 448 and the series of thread elements 449 have an equal number of teeth that oppose each other on either side of the finger 446. However, in alternative embodiments, the thread elements 448 and 449 may have an unequal number of teeth and may be located in different axial positions along the corresponding longitudinal edge with respect to each other.

Figure 10:
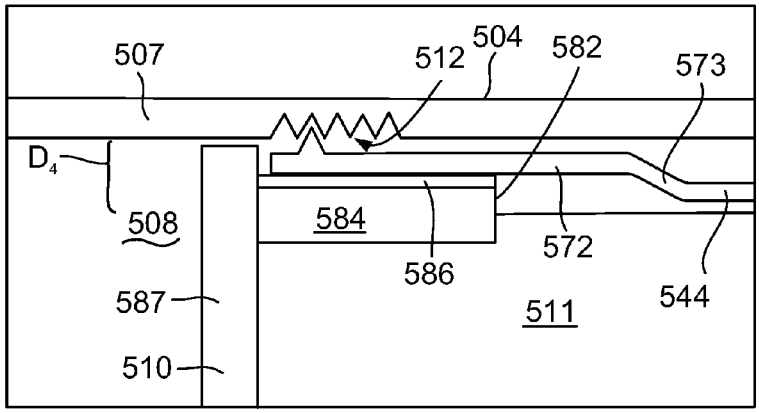
FIG. 10 is a partial, exposed side view of the connector assembly shown in FIG. 8 engaged with a mating connector.

FIG. 8 is a perspective view of a connector assembly 502 formed in accordance with another embodiment. The connector assembly 502 is configured to engage a mating connector 504 (a portion of which is shown in FIG. 10) having a cavity 508 (shown in FIG. 10) with internal threads 512 (shown in FIG. 10). Other components may operate similarly to some of the components described with respect to the connector assembly 102 in FIG. 1. As shown, the connector assembly 502 extends between a loading end (not shown) and a mating end 505 and along a longitudinal or central axis 590. The connector assembly 502 may include a plug body 510, a sleeve member 542 that surrounds the plug body 510, and a collar 530 that surrounds the central axis 590. The collar 530 is configured to move between a withdrawn position (shown in FIG. 8) to a locked position (shown in FIG. 10). The connector assembly 502 may include other components and features, such as those described in U.S. patent application Ser. No. 12/104,551, filed Apr. 17, 2008, or those described in the U.S. patent application Ser. No. 12/269,435, filed contemporaneously herewith, both of which are incorporated by reference in the entirety.

As will be discussed in greater detail below, the sleeve member 542 includes fingers 546 having outward projecting thread elements 548. When the collar 530 is rotated about the central axis 590 (as indicated by arrow R), the sleeve member 542 also rotates about the central axis 590. The fingers 546 are pushed outward away from the central axis 590 so that the thread elements 548 may engage the corresponding threads 512 within the cavity 508 of the mating connector 504. As such, the fingers 546 may engage the mating connector 504 and form an environmental seal to protect the electrical and/or fiber optic connection that extends through the connector assembly 502. In some embodiments, the sleeve member 542 forms an electrical shield as well.

In the illustrated embodiment, the plug body 510 has a cylindrical shape and defines a cavity 580 therein. The plug body 510 may house a plurality of mating contacts 512 within the cavity 580. The mating contacts 512 may be electrical contacts or, in alternative embodiments, fiber-optic termini. When the plug body 510 is inserted into the corresponding cavity, the mating contacts 512 are inserted into corresponding channels (not shown) to establish a communicative connection with the mating connector. However, in alternative embodiments, the plug body 510 may be similar to the plug body 110 and have contact channels for receiving mating contacts within the cavity of the mating connector 504.

The plug body 510 has an outer surface 511 and a plurality of ramp elements 582 that project radially outward therefrom. In the illustrated embodiment, the ramp elements 582 are distributed evenly about the surface 511 around the central axis 590 and are proximate to the mating end 505. The ramp elements 582 include an incline portion 584 and a platform 586. The incline portion 584 extends from the surface 511 and to the platform 586 at an angle relative to the curvature of the surface 511. Also shown, the plug body 510 includes a lip 587 located proximate to or at the mating end 505 that projects radially outward from the surface 511. The lip 587 projects a distance $D_4$ (shown in FIG. 10) from the surface 511.

Figure 9:
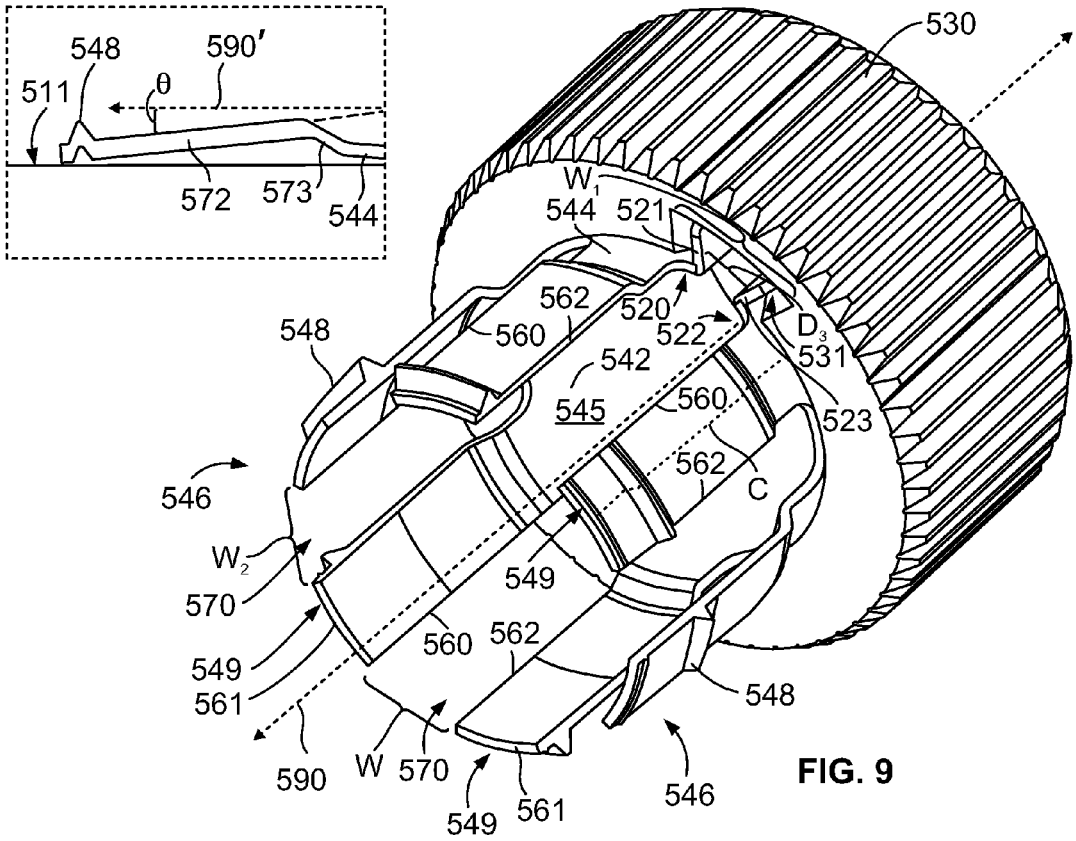
FIG. 9 is a perspective view of a sleeve member and a collar that may be used with the connector assembly shown in FIG. 8.

FIG. 9 is a perspective view of the collar 530 and the sleeve member 542. The sleeve member 542 includes a base portion 544 that extends around the central axis 590 and includes an inner surface 545. When in operation the inner surface 545 slides along the surface 511 of the plug body 510. The sleeve member 42 also includes a plurality of fingers 546 that project in a substantially axial direction toward the mating end 505. The base portion 544 includes two ends 520 and 522. The two ends 520 and 522 form tabs 521 and 523, respectively, that project radially outward from the base portion 544 of the sleeve member 542. The collar 530 includes a slot 531 having a width $W_1$ that receives the tabs 521 and 523. As shown, the tabs 521 and 523 are separated by a distance $D_3$. In the illustrated embodiment, the distance $D_3$ is less than the width $W_1$.

Also shown in FIG. 9, the fingers 546 are evenly distributed about the central axis 590. Each finger 546 is separated from adjacent fingers 546 by a gap or cut-out 570. The cut-out 570 has a width $W_2$ that extends between adjacent fingers 546. The width $W_2$ and shape of the cut-out 570 are configured such that a ramp element 582 (FIG. 8) may be located between adjacent fingers 546 when the connector assembly 502 is in the withdrawn position.

In the illustrated embodiment, each finger 546 has a substantially rectangular body that projects from the base portion 544 to a distal end 549. Each finger 546 is defined by longitudinal edges 560 and 562 that each extend to a common arcuate edge 561. Each finger 546 may have a constant radius of curvature. A box in FIG. 9 illustrates a cross-section of one of the fingers 546 taken along a broken line C. As shown, the finger 546 includes a body portion 572, a slope portion 573, and a part of the base portion 544. The slope portion 573 extends from the base portion 544 to the body portion 572 and extends away from and along the central axis 590 and. When the finger 546 is in a relaxed state, the body portion 572 extends at an angle θ with respect to a longitudinal axis 590', which extends parallel to the central axis 590. As such, the body portions 572 of the fingers 546 extend toward the central axis 590 while in the relaxed state. Also shown in FIG. 9, each finger 546 may have a thread element 548 that projects from an outer surface 547 of the finger 546 away from the central axis 590. As discussed above with respect to the thread elements 348A-D, the thread elements 548 may have different axial positions along the corresponding finger 546 and different configurations. In the illustrated embodiment, the thread elements 548 are ridges that extend completely between the longitudinal edges 560 and 562.

FIG. 10 illustrates a portion of the mating connector 504 when the plug body 510 and the sleeve member 542 are inserted into the cavity 508 of the mating connector 504. The mating connector 504 includes a stem wall 507 that has inner threads 512 defined along a surface of the stem wall 507. The stem wall 507 defines the cavity 508. As shown, the finger 546 is in a flexed or compressed state. To engage the connector assembly 502 with the mating connector 504, the mating end 505 (FIG. 8) is inserted into the cavity 508. In the illustrated embodiment, the distance $D_4$ is greater than a maximum height of the finger 546 when the finger 546 is in a relaxed state. As such, the mating end 505 may be inserted smoothly into the cavity 508 without the thread elements 548 catching the threads 512.

When the connector assembly 502 is fully inserted, the collar 530 (FIG. 8) is rotated about the central axis 590 (FIG. 8). In the illustrated embodiment, the collar 530 may be operatively coupled to the sleeve member 542. As such, when the collar 530 is rotated about the central axis 590, the sleeve member 542 is also rotated about central axis 590. However, because the distance $D_3$ separating the tabs 521 and 523 may be less than the width $W_1$ of the slot 531 that receives the tabs 521 and 523, the collar 530 may be slightly rotated and slide along the base portion 544 of the sleeve member 542 without moving the sleeve member 542. As such, the fingers 546 are not inadvertently moved from position when there is slight, inadvertent rotation.

When the collar 530 the tab 523, the sleeve member 542 is rotated in the same direction as the collar 530. The longitudinal edge 560 or each finger 546 first engages the incline portion 584 of the adjacent ramp element 582 causing the finger 546 to flex radially outward (i.e., away from the central axis 590). When the longitudinal edge 560 has cleared the incline portion 584, the body portion 572 of the finger 546 slides along the platform 586 and the thread element 548 engages the threads 512. The body portion 572 is compressed between the stem wall 507 of the mating connector 504 and the ramp element 582. As Such, the fingers 546 are configured to move from a pinched arrangement (i.e., when the fingers 546 extend inwardly) to a closed arrangement where the fingers 546 are compressed between a corresponding ramp element 582 and the stem wall 507 of the mating connector 504.

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first." "second," and "third." etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly configured to sealably engage with a mating connector, the mating connector including a cavity and an outer wall surface, the connector assembly comprising:

a plug assembly having a loading end and a mating end and a central axis extending therebetween, the mating end configured to be inserted into the cavity of the mating connector to establish at least one of a communicative and power connection;

a collar surrounding the plug assembly about the central axis and configured to slide in an axial direction between a withdrawn position and a locked position; and a sleeve member positioned between the collar and the plug assembly, the sleeve member surrounding the plug assembly about the central axis and comprising a plurality of fingers that extend toward the mating end, the sleeve member being stamped and formed from a common piece of sheet material, the fingers being biased away from the central axis in a flared arrangement when the collar is in the withdrawn position, wherein the fingers press against the wall surface of the mating connector when the collar is moved from the withdrawn position to the locked position.

2. The connector assembly in accordance with claim 1 wherein the sheet material has a common thickness throughout.

3. The connector assembly in accordance with claim 1 wherein the sheet material comprises a metal alloy.

4. The connector assembly in accordance with claim 1 wherein the sleeve member forms an electrical shield.

5. The connector assembly in accordance with claim 1 wherein each finger comprises a body and at least one thread element that projects radially inward from the body, the body and the at least one thread element being stamped and formed from the common piece of sheet material.

6. The connector assembly in accordance with claim 5 wherein the at least one thread element has an axial position relative to the central axis along the corresponding finger, the axial position of the at least one thread element on one finger being different from the axial position of the at least one thread element on an adjacent finger when engaged to the mating connector.

7. The connector assembly in accordance with claim 5 wherein each finger is at least partially defined between two longitudinal edges that extend substantially along the central axis, the at least one thread element including at least one ridge that extends between the two longitudinal edges, the at least one ridge being stamped and formed from the common piece of sheet material.

8. The connector assembly in accordance with claim 5 wherein the fingers are at least partially defined between two longitudinal edges that extend substantially along the central axis, the at least one thread element including a series of teeth along each longitudinal edge.

9. The connector assembly in accordance with claim 5, wherein the body of each finger includes a curved contour that curves around the central axis in a manner that substantially conforms to the outer wall surface of the mating connector.

10. The connector assembly in accordance with claim 5, wherein the sleeve member includes a base portion, the fingers extending from the base portion toward the mating end to respective distal ends, each finger being defined between inner and outer surfaces, the inner and outer surfaces along the body of each finger extending substantially parallel to the central axis when the collar is in the locked position from the base portion and to the respective distal end.

11. The connector assembly in accordance with claim 5, wherein the sleeve member includes a base portion that surrounds the plug assembly, the fingers extending from the base portion toward the mating end, the base portion extending around the central axis between separate ends that are positioned proximate to each other.

12. The connector assembly in accordance with claim 5 wherein the at least one thread element includes at least one tooth projection configured to engage the threads of the mating connector, the at least one tooth projection being stamped and formed from the common piece of sheet material.

13. The connector assembly in accordance with claim 12 wherein the fingers are at least partially defined between two longitudinal edges that extend substantially along the central axis, wherein the at least one tooth projection extends from one of the longitudinal edges and is bent radially inward.

14. A connector assembly configured to sealably engage with a mating connector, the mating connector having a cavity defined by an inner wall surface, the connector assembly comprising:

a plug body having a loading end and a mating end and a central axis extending therebetween, the mating end being configured for insertion into the cavity to establish at least one of a communicative and power connection, the plug body having an outer surface including a plurality of ramp elements that are located proximate to the mating end and project radially outward from the outer surface;

a sleeve member surrounding the outer surface of the plug body and comprising a plurality of fingers that extend toward the mating end, each finger being biased toward the central axis; and a collar operatively coupled to the sleeve member and configured to rotate the sleeve member about the central axis when the collar is rotated between a withdrawn position and a locked position, wherein each finger engages a corresponding ramp element when the collar is rotated to the locked position, the ramp elements deflecting the fingers radially away from the central axis and pressing the fingers against the inner wall surface when the collar is rotated to the locked position.

15. The connector assembly in accordance with claim 14 wherein the sleeve member is stamped and formed from a common sheet of material.

16. The connector assembly in accordance with claim 14 wherein each ramp element includes an incline portion that first engages the corresponding finger when the sleeve member is rotated, the incline portion deflecting the corresponding finger away from the central axis when the collar is rotated about the central axis to the locked position.

17. The connector assembly in accordance with claim 14 wherein the sleeve member includes a base portion that surrounds the plug body about the central axis, each finger extending from the base portion.

18. The connector assembly in accordance claim 14 wherein the fingers have a maximum height away from the outer surface and the plug body includes a lip projecting radially outward from the outer surface and proximate to the mating end, the lip projecting a distance away from the outer surface that is greater than the maximum height of the fingers.

19. The connector assembly in accordance with claim 14 wherein each finger includes at least one thread element that projects radially outward, the at least one thread element configured to engage the inner wall surface of the mating connector when the finger is deflected away from the central axis and pressed against the inner wall surface.

20. The connector assembly in accordance with claim 19 wherein the at least one thread element has an axial position along the corresponding finger, the axial position(s) of the at least one thread element on one finger being different from the axial position(s) of the at least one thread element on an adjacent finger.

* * * * *